US010323807B2

(12) United States Patent
Sterkina et al.

(10) Patent No.: US 10,323,807 B2
(45) Date of Patent: Jun. 18, 2019

(54) METHOD OF GENERATING A LIGHT OUTPUT AND AN ELONGATE CORNICE LAMP FOR THE IMPLEMENTATION THEREOF

(71) Applicants: Natalia Olegovna Sterkina, Moscow (RU); Svetlana Aleksandrovna Sterkina, Moscow (RU)

(72) Inventors: Natalia Olegovna Sterkina, Moscow (RU); Svetlana Aleksandrovna Sterkina, Moscow (RU)

( * ) Notice: Subject to any disclaimer, the term of this patent is extended or adjusted under 35 U.S.C. 154(b) by 0 days.

(21) Appl. No.: 15/753,900

(22) PCT Filed: Aug. 15, 2016

(86) PCT No.: PCT/RU2016/000542
§ 371 (c)(1),
(2) Date: Feb. 20, 2018

(87) PCT Pub. No.: WO2017/030468
PCT Pub. Date: Feb. 23, 2017

(65) Prior Publication Data

US 2018/0245756 A1 Aug. 30, 2018

(30) Foreign Application Priority Data

Aug. 20, 2015 (RU) ..... 2015135201

(51) Int. Cl.
*F21S 8/00* (2006.01)
*F21S 4/28* (2016.01)
(Continued)

(52) U.S. Cl.
CPC ..... *F21S 8/033* (2013.01); *F21S 4/28* (2016.01); *F21V 5/007* (2013.01); *F21V 7/005* (2013.01);
(Continued)

(58) Field of Classification Search
CPC ..... F21S 6/003; F21Y 2115/10
See application file for complete search history.

(56) References Cited

U.S. PATENT DOCUMENTS 5,471,371 A 11/1995 Koppolu et al.
8,322,881 B1 * 12/2012 Wassel ..... F21V 7/00 362/247
(Continued)

FOREIGN PATENT DOCUMENTS

DE 10140692 A1 3/2003
JP 2004349166 8/2008
(Continued)

OTHER PUBLICATIONS

Search Report for corresponding Registration No. 2015135201/07(053939) dated Dec. 5, 2016.
(Continued)

*Primary Examiner* — Andrew J Coughlin
(74) *Attorney, Agent, or Firm* — Wood, Phillips, Katz, Clark & Mortimer

(57) ABSTRACT

The proposed method and device relate to the field of lighting technology and are intended for generating a light output indoors such as to provide uniform lighting. The housing of an elongate cornice lamp is comprised of the following components, fastened to one another: a primary plate for accommodating LED strips which generate a light output, a plate for reflecting the light output, a plate for restricting the light output, and a mounting plate. An electric power supply is disposed inside the cavity of the housing. The necessary number of LEDs is selected and these are mounted on LED strips which are fastened on the primary plates and on the plates for reflecting the light output, the LEDs are connected to the electric power supply, a set of light beams is produced, the luminous intensity of the light beams is controlled, the angles of spatial distribution of the
(Continued)

Figure 1:
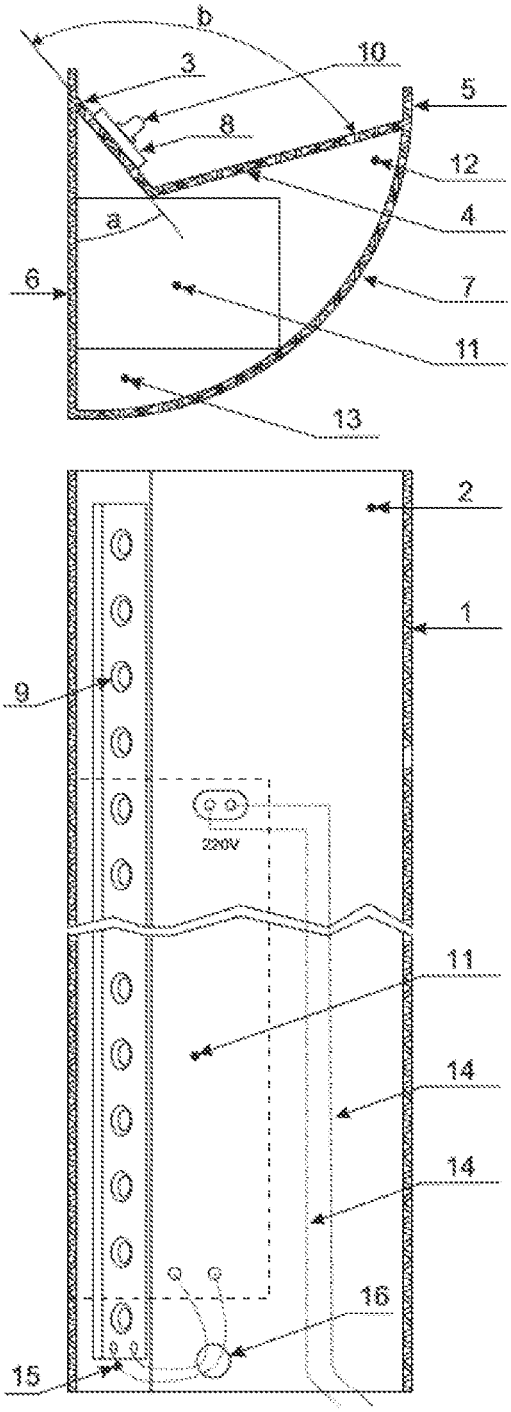

light are modified by additional lenses, the light output is distributed with the aid of the reflecting surfaces, and the dispersion of the light output in unwanted directions is prevented with the aid of the restricting surfaces.

10 Claims, 7 Drawing Sheets

(51) Int. Cl.

| | |
|---|---|
| ***F21V 7/00*** | (2006.01) |
| ***F21V 5/00*** | (2018.01) |
| ***F21V 13/04*** | (2006.01) |
| *F21Y 103/10* | (2016.01) |
| *F21Y 115/10* | (2016.01) |
| *F21V 23/00* | (2015.01) |
| *F21V 23/02* | (2006.01) |
| *F21V 5/04* | (2006.01) |
| *F21V 7/05* | (2006.01) |

(52) U.S. Cl.
CPC ..... *F21V 7/0008* (2013.01); *F21V 7/0066* (2013.01); *F21V 7/0083* (2013.01); *F21V 13/04* (2013.01); *F21V 5/048* (2013.01); *F21V 7/05* (2013.01); *F21V 23/003* (2013.01); *F21V 23/02* (2013.01); *F21Y 2103/10* (2016.08); *F21Y 2115/10* (2016.08)

(56) References Cited

U.S. PATENT DOCUMENTS

2002/0130326 A1* 9/2002 Tamura ..... F21K 9/00 257/79
2003/0189829 A1* 10/2003 Shimizu ..... F21L 4/00 362/240
2004/0124430 A1* 7/2004 Yano ..... H01L 33/44 257/98
2004/0190304 A1* 9/2004 Sugimoto ..... H01L 33/507 362/555
2006/0186425 A1* 8/2006 Yano ..... F21K 9/68 257/98
2007/0228947 A1* 10/2007 Tanimoto ..... F21K 9/00 313/506

FOREIGN PATENT DOCUMENTS

| | | | |
|---|---|---|---|
| RU | 2401395 | C1 | 10/2010 |
| RU | 2489641 | C1 | 8/2013 |
| RU | 148495 | U1 | 12/2014 |
| RU | 154093 | U1 | 8/2015 |
| WO | 2005036054 | A1 | 4/2005 |
| WO | 2011159995 | A1 | 12/2011 |

OTHER PUBLICATIONS

Inquiry of substantive examination for corresponding Registration No. 2015135201/07(053939) dated Dec. 8, 2016.
Decision on Granting a Patent for Invention for corresponding Registration No. 2015135201/07(053939) dated May 4, 2017.
International Search Report for corresponding PCT Application No. PCT/RU2016/000542.
International Report on Patentability for corresponding PCT Application No. PCT/RU2016/000542.

* cited by examiner

METHOD OF GENERATING A LIGHT OUTPUT AND AN ELONGATE CORNICE LAMP FOR THE IMPLEMENTATION THEREOF

The provided method and device relate to the field of lighting engineering and are intended for using as a Method of generating a light flow and as an elongate cornice lamp for the implementation in office, trade, sport, industrial and other premises, including premises with high humidity and dustiness.

RELATED ART

In order to illustrate the known state of the art in this field the objects protected by the RF patents for inventions No. 2240470, 24099162, 473007, 2502013, 2506492, 2509952 as well as RF patents for utility models No. 2101 147 and No. 154093 could be mentioned. The disadvantages of the known methods and devices are, in particular, their overheating during operation and limited capabilities of the light output control. The closest analog (prototype) to the claimed technical solution for the terms of essential features is the method and device disclosed in the above mentioned description of the patent for utility model No. 154093.

The problem solved by the claimed objects, is in improvement of known methods and devices in order to eliminate their disadvantages and achieve technical result in regard to the expansion of capabilities of a lamp radiation direction diagram control with high uniformity of illumination.

BRIEF DESCRIPTION OF DRAWINGS AND DESIGNATIONS

The mentioned advantageous effect is achieved via the provided method and the device, the distinctive features of which are schematically shown on the following figures of drawings.

1. A general view of a lamp with a LED strip on a main arrangement plate and its cross-section.

2. A general view of the lamp with the LED strip on a light output reflection plate and its cross-section.

3. An illustration of the preferable lamp mounting.

4. A diagram of the generating light output without usage of the LED strip on the reflecting surface in the lamp.

5. A diagram of the generating a light output with usage of the LED strip on the reflecting surface in the lamp.

6. An illustration of the direct light output impact without protection of the human eye field of vision.

7. An illustration of the direct light output impact with the protective plate for limitation of the human eye field of vision.

8. An illustration of generation of the uniform light output with usage of the LEDs with different lens types: A without lenses, B with narrow-range lenses, C combination on one line of the LEDs with narrow-range and wide-range lenses.

DESIGNATED ON THE FIGURES

"a"—the angle between the main arrangement plate of the LED strips forming light output and the mounting plate.

"b"—the angle between the main arrangement plate of the LED strips forming light output and the light output reflection plate.

"c"—the angle of transformation via lenses of spatial distribution of the light output.

The main structural assemblies and specific characteristics of the claimed method and device are identified via the list of their designations on the mentioned figures, namely:

1. A lamp.
2. A profiled lamp housing.
3. A main arrangement plate of the LED strips, forming a light output.
4. A light output reflection plate.
5. A light output limitation plate.
6. A lamp housing mounting plate.
7. A load-carrying profiled housing area.
8. A LED strip.
9. LEDs.
10. Lenses for transformation of the spatial distribution of the light output.
11. A Power supply and a control unit.
12. A body cavity for mounting of power supply and a control unit.
13. Additional housing cavity for arrangement of electrical wiring.
14. Electrical wiring.
15. Additional wires, connecting LED strip and the lamp power supply unit.
16. An opening for wires in a light output reflection plate.
17. An additional LED strip for generation of color or other kind of the lighting effect, for example, soporific.
18. A control unit for the additional LED strip.
19. A wall.
20. A ceiling.
21. The distance from the ceiling to the lamp.
22. A multiple-core power wire, providing to all possible units of the elongate lamp power supply from one point.
23. Light rays from the LED and reflected from the ceiling.
24. Lamps without a protective light output limitation plate.
25. Light rays from the additional LEDs on the reflection plate and reflected from the wall and the ceiling.
26. Dark areas between the LEDs.
27. A stylized image of the human eye.
28. The LEDs without lenses.
29. The LEDs with lenses.
30. Wide-angle polar plots of the light radiation direction.
31. Narrow-angle polar plots of the light radiation direction.

DETAILED DESCRIPTION AND EXAMPLES OF EMBODIMENTS

When describing in details the method and device (FIG. 1-8), it is inadvisable to fix on their technical and structural features known from the published sources, but only their essential features should be characterized in more details. To achieve the mentioned advantageous effect the method of generating a light output is provided, according to which the LED 9 quantity is chosen within the range of $10\text{-}10^5$ pieces, they are mounted on the LED strips 8, which are chosen within the range of $1\text{-}10^3$ pieces, and they are connected to the power supply and the light output control unit 11. The LED strips 8 are secured on the main arrangement plates 3 in quantity of 1-120 and on the additional arrangement plates in quantity of 1-120, as well as on the light output reflection plates 4 in quantity 1-120. The angles of the slope to the horizon of the plates 3 and 4 with the LED strips 8 mounted on them are chosen within the range of 5° to 85°, and via assembly of the mounted LEDs 9 suitable light beams combination is generated.

Luminous intensity in $n_1$ part of light beams, chosen in relation to their general quantity n within the range of $1 \leq (n_1+n)/n \leq 2$, is controlled by changing of the electric power, input to the LEDs 9 within the range of 10-100% of its maximum value. The light spatial distribution angles in $n_2$ light beams, chosen in relation to their general quantity n within the range of $1 \leq (n_2+n)/n \leq 2$, are transformed by the additional lenses 10 within the range of 7°-120°. A light output generated by the light beams combination is diffused by the reflecting surfaces chosen in quantity of 1-120, for example, the plates 4, and its distribution in undesirable directions is overlapped by the limiting surfaces chosen in quantity of 1-120, for example, the plates 5. Also a light output is redirected by the reflecting surfaces chosen in quantity of 1-120, for example, the plates 4, polar plots of light distribution of light beams of LEDs 9 are selected and adjusted among others with the additional lenses 10, achieving non-uniformity of the illumination by the generated light output, not exceeding 5-30% of its maximum value.

Mentioned advantageous effect is also achieved by the provided elongate cornice lamp for the implementation of the claimed method, consisting of an elongate form of rigidly fixed to each other: a main arrangement plate 3 of the LED strips 8 with the LEDs 9, forming a light output, a light output reflection plate 4, a light output limitation plate 5, a mounting plate 6 and a load-carrying profiled housing area 7. The plates 3, 4 and 6 as well as the area 7 form a cavity 12 in a housing 2 for mounting of a power supply and a lamp control unit 11 in it.

Herewith one end of the profiled housing area 7 is rigidly connected with the end of mounting plate 6 and the other end is rigidly connected with the light output reflection plate's 4 end and the light output limitation plate's 5 end. Therewith the main arrangement plate 3 of the LED strips 8 forming a light output is mounted at an angle "a" within the range of $7° \leq a \leq 70°$ to the mounting plate 6 and is mounted at an angle "b" within the range of $80° \leq b \leq 150°$ to the light output reflection plate 4.

To make structural features of the developed lamp 1 more specific it is expediently to mention that the rigid attachment of the main arrangement plate 3 for the LED strips 8 forming a light output, a light output reflection plate 4, a light output limitation plate 5, a mounting plate 6 and a load-carrying profiled housing 2 area 7 may be formed by punching or extrusion from a monolithic work piece. The quantity of the LED strips 8 with the LEDs 9 mounted on the main arrangement plate of a lamp may be selected within the range of 1-120. An additional quantity of the LED strips 8 with the LEDs 9 may be arranged on the light output reflection plate 4, selected within the range of 1-120.

In the lamp 1 part $n_1$ of the LEDs 9, selected in relation to their general quantity n within the range of $1 \leq (n_1+n)/n \leq 2$, may be equipped with the additional lenses 10 for the transformation of the light output spatial distribution. Herewith the part $n_2$ of the lenses 10 selected in relation to their general quantity $n_1$ within the range of $1 \leq (n_2+n_1)/n_1 \leq 2$ may be performed with the angle "c" of transformation of the light output spatial distribution within the range of $7° \leq c \leq 30°$. The part $n_3$ of the lenses 10 selected in relation to their general quantity $n_1$ within the range of $1 \leq (n_3+n_1)/n_1 \leq 2$ may be performed with the angle "c" of the transformation of the light output spatial distribution within the range of $10° \leq c \leq 45°$, the part $n_4$ of the lenses 10 selected in relation to their general quantity $n_1$ within the range of $1 \leq (n_4+n_1)/n_1 \leq 2$ may be performed with the angle "c" of the transformation of the light output spatial distribution within the range of $15° \leq c \leq 60°$, and part $n_5$ of the lenses 10 selected in relation to their general quantity $n_1$ within the range of $1 \leq (n_5+n_1)/n_1 \leq 2$ may be performed with the angle "c" of the transformation of the light output spatial distribution within the range of $10° \leq c \leq 120°$.

The variability of the usage of the claimed method features of the lamp structural elements at different combinations of their forms, sizes and quantities mentioned above for the adjustment of the wide-angle 30 and the narrow-angle 31 plots of direction and the angular distribution of the light beams 23, 25 and light beams generated by them illustrates the structural design and functioning of the lamp, what is clearly shown on the FIG. 1-8. On the FIG. 1, in particular, a variant of the general view of a lamp with the LED strip 8 on the main arrangement plate 3 and its cross-section with the power supply and control unit 11, mounted in the cavity 12 of the housing 2 of the lamp 1, is shown. An additional housing cavity 17 for the arrangement of the electrical wiring 14 is arranged in the bottom part of the housing 2. Also, for example, additional wires 15, connecting the LED strips 8 and the power supply unit 11 of the lamp 1 may be mounted through the opening 16 in the light output reflection plate 4.

Figure 2:
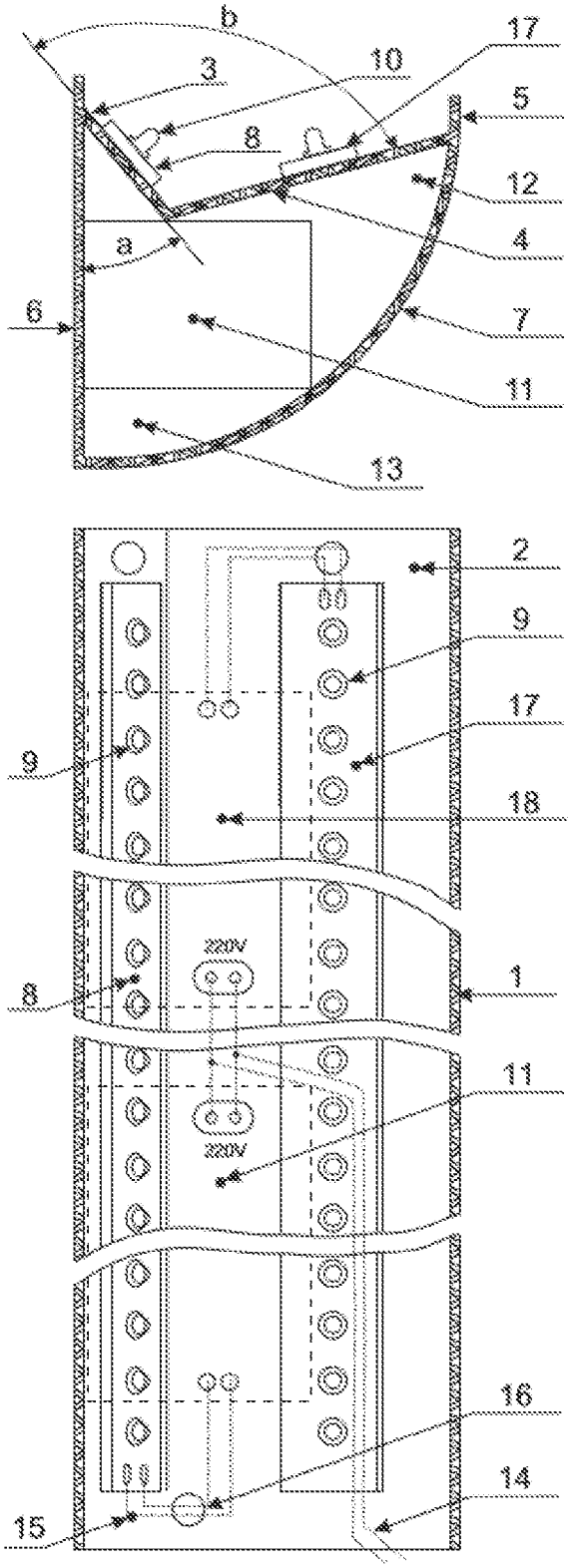
Figure 3:
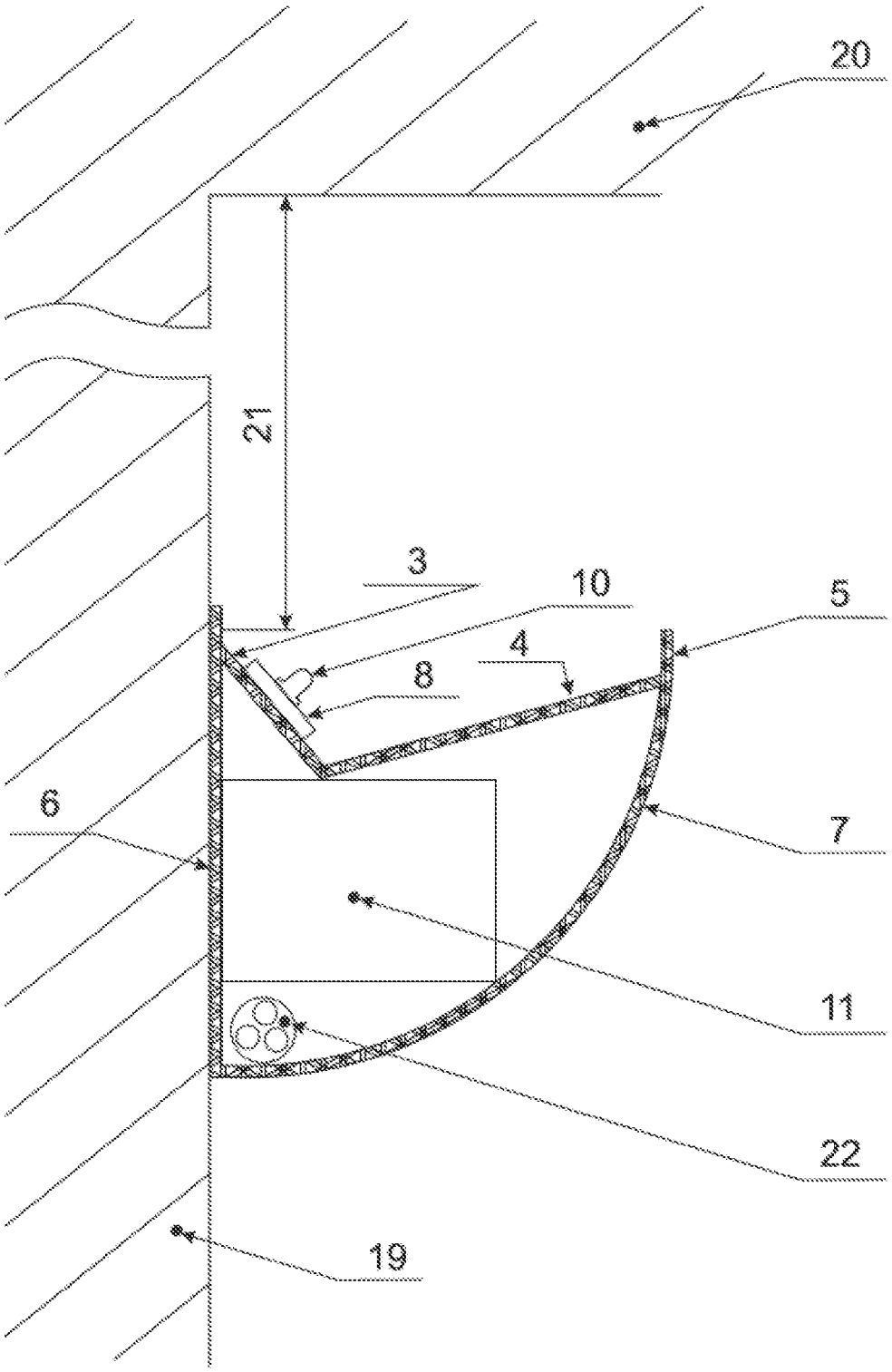

On the FIG. 2 a variant of the general view of the lamp 1 with the additional LED strip 17 on the light output reflection plate 4 and its cross-section are is shown. The additional control unit 18 is provided for the additional LED strip 17. An illustration of the preferable lamp mounting in its cross-section is shown on the FIG. 3. The lamp is fixed with the mounting plate 6 on the wall 19 within a distance 21 from the ceiling 20. In the bottom part of the lamp housing a multiple-core power wire 22 is shown to which provides current, providing power supply for the whole system of the LEDs 9 from one point, to all possible units of the elongate lamp.

Figure 4:
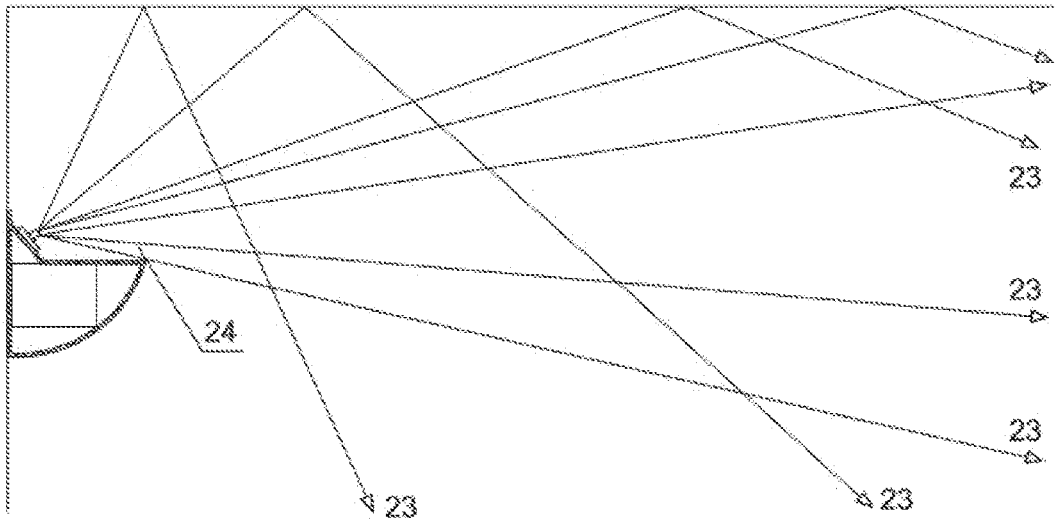
Figure 4:
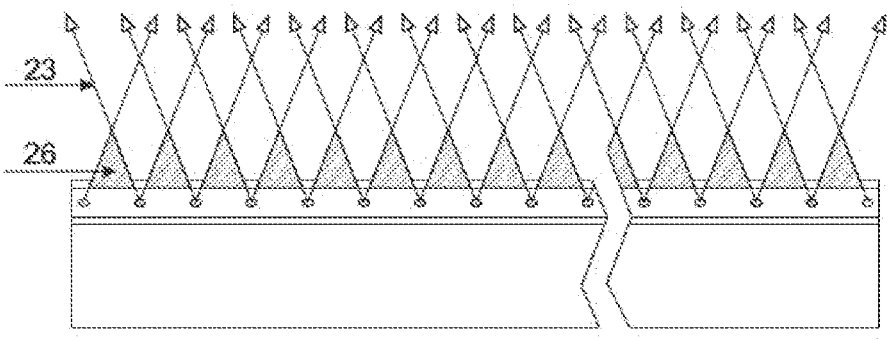
Figure 5:
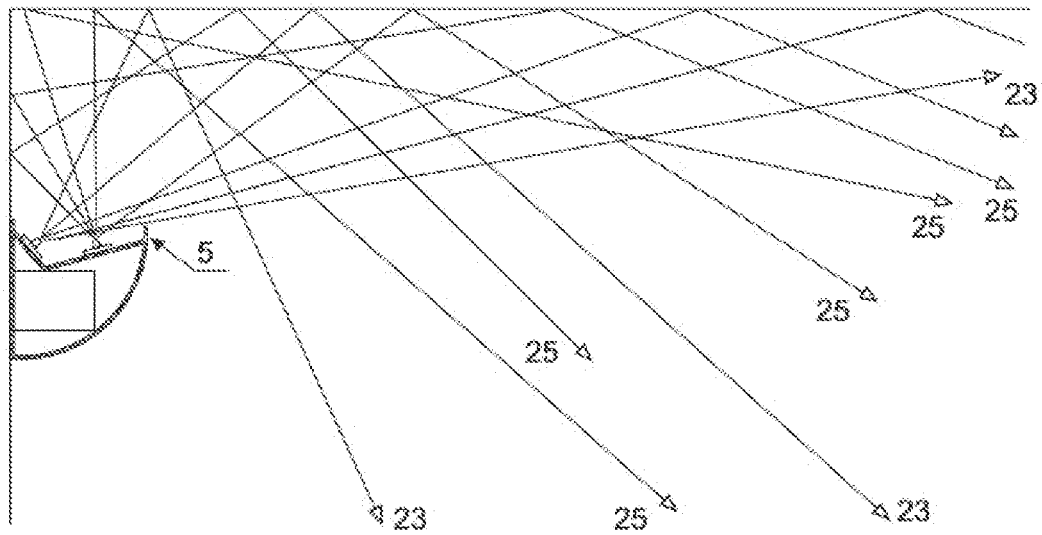
Figure 5:
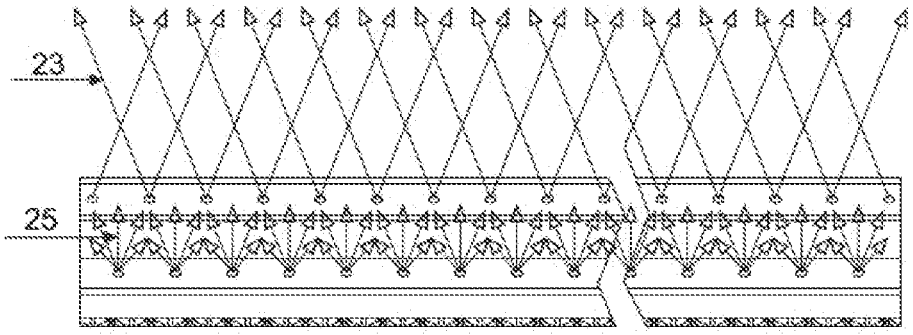

On the FIG. 4 a scheme of generating a light output without usage in the lamp of the LED strip on the reflecting surface is shown. Here the light beams 23 from the LED and reflected from the reflection surface are shown, for example, from the ceiling. Also the dark areas 26 between the LEDs are shown, that are eliminated, as shown on the FIG. 5, by using of the LED light beams 23, mounted on their main arrangement plate, and the beams 25 from the additional LEDs on the reflection plate as well as the beams 23 and 25, reflected from the wall and the ceiling.

Figure 6:
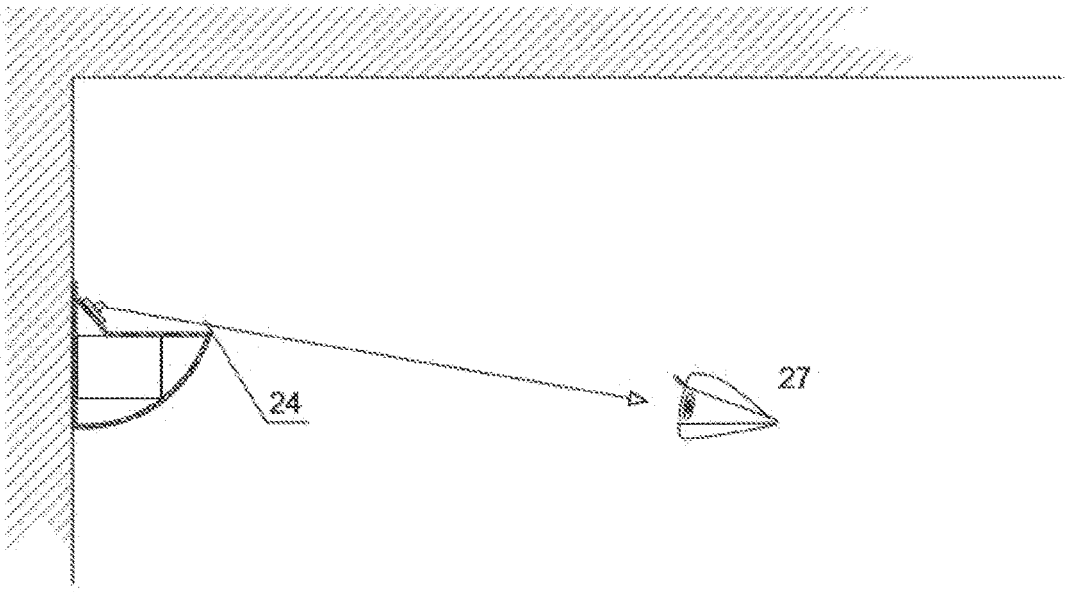
Figure 7:
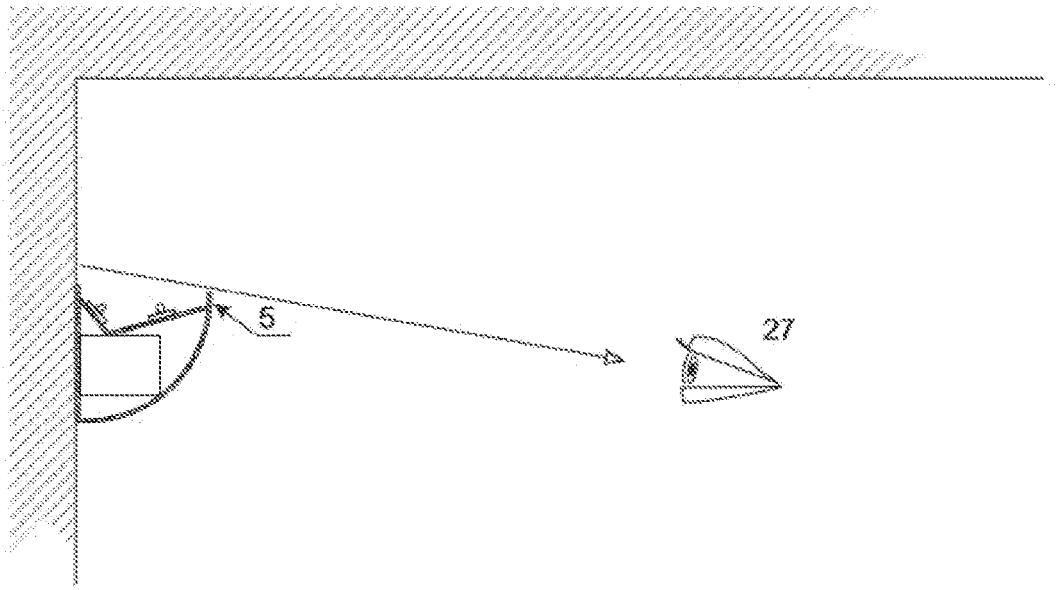
Figure 8:
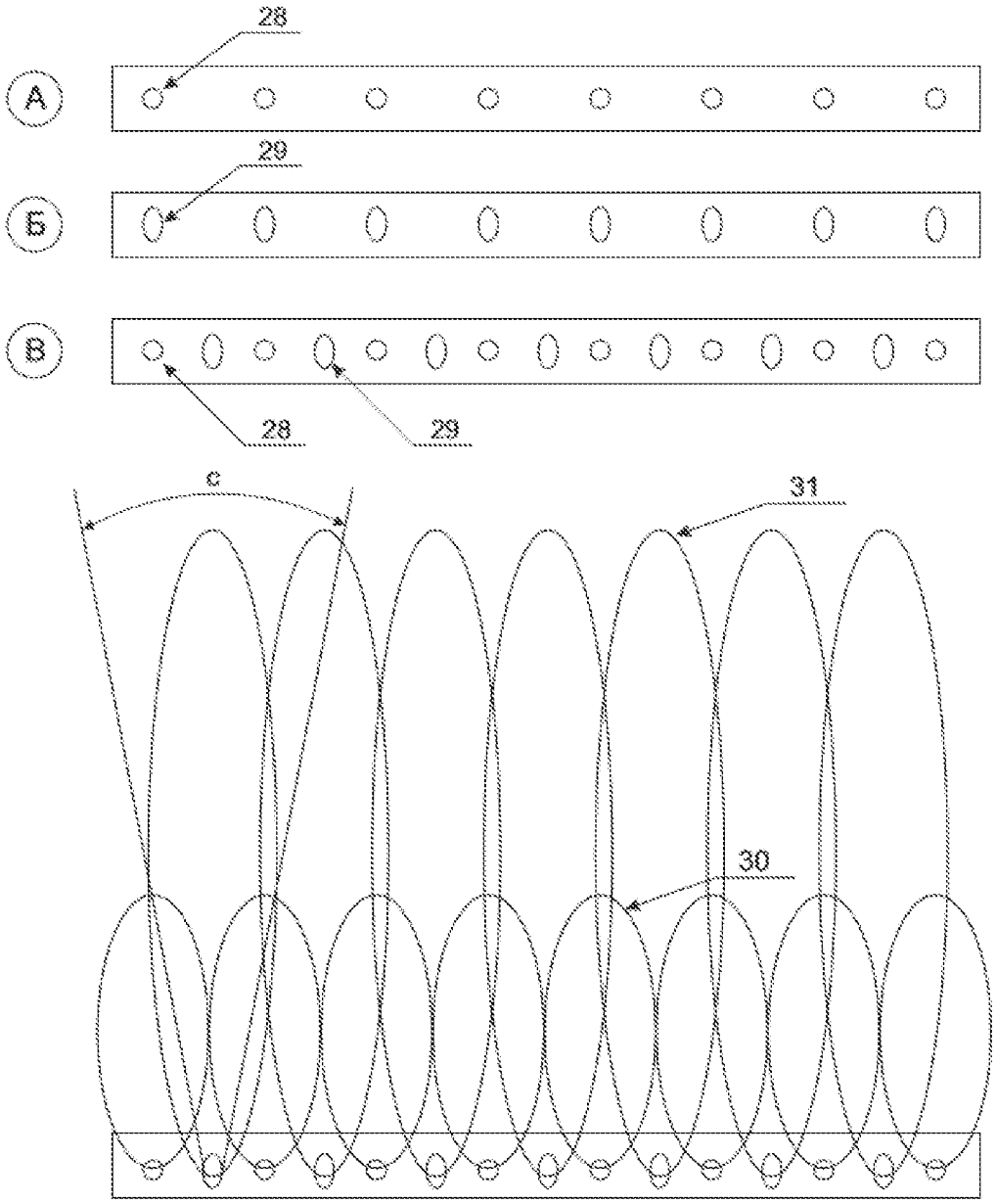

On the FIG. 6 an illustration of the impact of the direct light output from the LEDs without protection of the human eye 27 field of vision from the lamp 24 without the protective plate for limitation of the light output is shown. On the FIG. 7 an illustration of the elimination of the impact of the direct light output from the LEDs and only the reflected light output with protection of the human eye 27 field of vision by the protective plate 5 for limitation of the light beams is shown. An illustration of the generation of the uniform light output with the usage of the LEDs 28 with different lens types and without them is provided on the FIG. 8: A—without lenses, B—with narrow-range lenses 29, C—a combination on the one line of LEDs with narrow-range and wide-range lenses. As a result the wide-angle 30 and the narrow-angle 31 polar plots of the light radiation direction are generated with the angle "c" of a transformation by the light output spacious distribution lenses, selected within the range mentioned above, which is shown on the FIG. 8.

As a result, the light output generated by the set of light beams is distributed by the chosen reflecting surfaces and its distribution in undesirable directions is overlapped by limiting surfaces and redirected by reflecting surfaces. Herewith polar plots of the light distribution of the light beams of the LEDs are selected and adjusted among others with additional lenses, and controlled as well, achieving non-uniformity of the illumination by the generated light output, not exceeding 5-30% of its maximum value.

It should be noted that principle of unity of invention is fulfilled in the application as the provided method and the lamp have the same name, serve the same goal, provide an achievement of the same advantageous effect together and are connected by a single inventive conception, characterized by the claims. Herewith the legal protection conception is based on the fact that continuity and interconnection of the provided objects as well as assumed variability of the implementation of specific essential features or their combinations predetermine, among others, non-traditional formulation character of several features. For example, lamp structural features are shown not only by the characteristic of its assemblies and their structural interconnections, but also by, in particular, the angles "c" of the transformation of a spacious distribution of the light output within selected limits.

INDUSTRIAL APPLICABILITY AND ACHIEVEMENT OF THE TECHNICAL RESULT

Therefore, as seen from above, the features mentioned in the claims are essential and purposefully interconnected with each other with generation of their steady combination necessary and sufficient for an achievement of the stated effect of the invention. An achievable technical result, as it was shown by experimental data, can be implemented only by an interconnected combination of the all essential features of the claimed objects, shown in the claims, at any of their values, covered by the claimed claims and satisfying the claimed features. The claimed essential distinctive features were obtained on the basis of creative processing of the conducted studies and experiments, analysis and generalization of them and known from published sources of data, interconnected by the conditions of achieving the technical result specified in the application and as well as using inventive intuition.

The proposed method and the lamp for its implementation do not contain features that cannot be implemented by known technologies and devices. Conformity to the criterion of "industrial applicability" the proposed objects is also proved by absence in the claims of any features that are practically difficult to implement in an industrial scale.

Among other advantages of the described lamp implementing the claimed method it could be noted the relatively low manufacturing cost and attractive ergonomic indicators.

What is claimed is:

1. A method of generating a light output, comprising:

a) mounting between $10\text{-}10^5$ light emitting diodes (LEDs) on $1\text{-}10^3$ LED strips;

b) connecting the LED strips to an electric power supply and light output control unit;

c) securing between 1 to 120 of the LED strips on a main arrangement plate;

d) securing between 1 to 120 of the LED strips on an additional arrangement plate;

e) securing between 1 to 120 of the LED strips on a light output reflection plate;

wherein angles between the horizon and the main arrangement plate; the horizon and the additional arrangement plate; and the horizon and the light output reflection plate are each between 5°-85°;

wherein the LEDs generate an aggregate of light beams, wherein the total number of light beams is n, and further wherein a radiant intensity of $n_1$ of light beams is controlled by varying of the electric power connected to said LEDs within the range of 10-100%, wherein $1 \leq (n_1+n)/n \leq 2$, wherein light spatial distribution angles of $n_2$ light beams, wherein $1 \leq (n_2+n)/n \leq 2$, are transformed within the range of 7-120° by lenses, wherein the light output generated by the aggregate of light beams is dissipated by 1-120 reflecting surfaces, and wherein the light output is redirected by the 1-120 reflecting surfaces.

2. An extended cornice lamp, comprising a housing, wherein the housing consists of an extended configuration of several parts rigidly fixed to each other, wherein said several parts comprise:

a) a main arrangement plate;

b) an additional arrangement plate;

wherein said main arrangement plate and said additional arrangement plate comprise light emitting diodes (LED) strips comprising LEDs forming a light output; and further wherein additional lenses are placed on a portion of the LEDs to convert the spatial distribution of the light output and wherein further additional lenses are placed on the portion of the LEDs to adjust polar diagrams of the light distribution of the light beams produced by the portion of the LEDs, c) a light output reflection plate;

d) a light output blocking plate;

e) a mounting plate;

f) a load-carrying graded housing area, wherein a cavity is formed in the housing for mounting of a power supply and a lamp control block and a power supply and a control block for the additional lenses, wherein one end of the housing graded area is rigidly connected with an end of the mounting plate and wherein the other end of the housing graded area is rigidly connected with an end of the light output reflection plate and with an end of the light output limitation plate, and wherein the main arrangement plate is mounted at an angle "a" to the mounting plate, and is mounted at an angle "b" to the light output reflection plate, and wherein the angle a is greater than 7° but less than 70°, and wherein the angle b is greater than 80° but less than 150°.

3. The lamp of the claim 2, where the rigid attachment of the main arrangement plate, the additional arrangement plate, the light output reflection plate, the light output limitation plate, the mounting plate and the load-carrying graded housing area is formed by punching or extrusion from a monolithic work piece.

4. The lamp of the claim 3, wherein the portion of the LEDs is equal to $n_1$, and wherein $1 \leq (n_1+n)/n \leq 2$.

5. The lamp of the claim 4, wherein $n_2$ of the lenses is performed with the angle "c" of a transformation of the light output spatial distribution within the range of $7° < c < 30°$, and wherein $1 \leq (n_2+n_1)/n_1 \leq 2$.

6. The lamp of the claim 4, wherein $n_3$ of the lenses is performed with the angle "c" of a transformation of the light output spatial distribution within the range of $10° < c < 45°$, and wherein $1 \leq (n_3+n_1)/n_1 \leq 2$.

7. The lamp of the claim 4, wherein $n_4$ of the lenses is performed with the angle "c" of a transformation of the light output spatial distribution within the range of $15° < c < 60°$, and wherein $1 \leq (n_4+n_1)/n_1 \leq 2$.

8. The lamp of the claim 4, wherein n5 of the lenses is performed with the angle "c" of a transformation of the light output spatial distribution within the range of $10° < c < 120°$, and wherein $1 \leq (n_5+n_1)/n_1 \leq 2$.

9. The lamp of the claim 2, wherein the main arrangement plate comprises 1-120 LED strips.

10. The lamp of the claim 2, wherein the light output reflection plate comprises 1-120 LED strips.

* * * * *